US009694254B2

(12) United States Patent
Ashino

(10) Patent No.: US 9,694,254 B2
(45) Date of Patent: Jul. 4, 2017

(54) GOLF CLUB HEAD

(71) Applicant: DUNLOP SPORTS CO. LTD., Kobe-shi, Hyogo (JP)

(72) Inventor: Takeshi Ashino, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 14/434,028

(22) PCT Filed: Oct. 10, 2013

(86) PCT No.: PCT/JP2013/077621
§ 371 (c)(1),
(2) Date: Apr. 7, 2015

(87) PCT Pub. No.: WO2014/061557
PCT Pub. Date: Apr. 24, 2014

(65) Prior Publication Data

US 2015/0273289 A1 Oct. 1, 2015

(30) Foreign Application Priority Data

Oct. 17, 2012 (JP) ..... 2012-229472

(51) Int. Cl.
*A63B 53/04* (2015.01)
*A63B 60/52* (2015.01)

(52) U.S. Cl.
CPC ..... *A63B 53/0466* (2013.01); *A63B 53/04* (2013.01); *A63B 60/52* (2015.10); *A63B 2053/045* (2013.01); *A63B 2053/0437* (2013.01)

(58) Field of Classification Search
CPC ..... A63B 2053/0416; A63B 2053/045; A63B 53/0466
USPC ..... 473/287–292, 324–350
See application file for complete search history.

(56) References Cited

U.S. PATENT DOCUMENTS 7,108,614 B2 * 9/2006 Lo ..... A63B 53/0466 473/345
7,281,992 B2 * 10/2007 Tseng ..... A63B 53/0466 473/345
7,448,964 B2 * 11/2008 Schweigert ..... A63B 53/0466 473/345

(Continued)

FOREIGN PATENT DOCUMENTS

JP 3073997 U 12/2000
JP 2004-159794 A 6/2004

(Continued)

*Primary Examiner* — Nini Legesse
(74) *Attorney, Agent, or Firm* — Birch, Stewart, Kolasch & Birch, LLP

(57) ABSTRACT

To provide a golf club head excellent in hitting sound and flight distance performance. A head includes a face, a crown and a sole. The crown has an inner surface on which grid-form rib is provided. When a region on which the grid-form rib is provided is defined as a rib region, an additional rib is further provided on the rib region. The additional rib is positioned on a heel side relative to a face center. Preferably, the grid-form rib is formed by intersection of first ribs extending in a substantially toe-heel direction and second ribs extending in a substantially face-back direction. Preferably, the additional rib is sloped to be closer to a back side as approaching to the heel side.

11 Claims, 6 Drawing Sheets

(56) References Cited

U.S. PATENT DOCUMENTS

| | | | | |
|---|---|---|---|---|
| 8,540,590 | B2 * | 9/2013 | Tsukada | A63B 53/0466 473/345 |
| 2005/0037861 | A1 * | 2/2005 | Kobayashi | A63B 53/04 473/345 |
| 2006/0052181 | A1 * | 3/2006 | Serrano | A63B 53/0466 473/345 |
| 2008/0045356 | A1 * | 2/2008 | Lin | A63B 53/0466 473/346 |
| 2010/0255931 | A1 * | 10/2010 | Ni | A63B 53/0466 473/346 |
| 2011/0306441 | A1 | 12/2011 | Tsukada et al. | |
| 2014/0329616 | A1 * | 11/2014 | Stokke | A63B 53/0466 473/346 |

FOREIGN PATENT DOCUMENTS

| | | | |
|---|---|---|---|
| JP | 4262369 | B2 | 5/2009 |
| JP | 2012-161 | A | 1/2012 |
| JP | 2012-45235 | A | 3/2012 |
| JP | 2013-240404 | A | 12/2013 |

* cited by examiner

GOLF CLUB HEAD

TECHNICAL FIELD

The present invention relates to a golf club head.

BACKGROUND ART

In a hollow head, a technique for providing a rib on an inner surface of a crown has been disclosed. Japanese Patent No. 4262369 discloses a wood club head in which at least three ribs (A) and at least three ribs (B) are provided on the reverse surface of the crown. Slope angles of the ribs (A) and the ribs (B) are equal to or less than 45° relative to a face center line. The ribs (A) and the ribs (B) are sloped in opposite directions each other.

Japanese Patent Application Laid-Open No. 2012-45235 discloses a crown part on which a plurality of thick parts extending from a face side toward a back side are formed.

CITATION LIST

Patent Literature

Patent Literature 1: Japanese Patent No. 4262369

Patent Literature 2: JP-A-2012-45235

SUMMARY OF THE INVENTION

Problems to be Solved by the Invention

In hollow heads, hitting sound is great. The hitting sound has been emphasized as a performance of a head. In hollow heads, a distance of a center of gravity is likely to be long. In this case, the head is likely to be turned at impact and the catch of the ball is likely to be deteriorated. The deterioration reduces flight distance.

It is an object of the present invention to provide a golf club head excellent in hitting sound and flight distance performance.

Solution to the Problems

A golf club head according to the present invention includes a face, a sole and a crown. Grid-form rib is provided on an inner surface of the crown. When a region on which the grid-form rib is provided is defined as a rib region, an additional rib is further provided on the rib region. The additional rib is positioned on a heel side relative to a face center.

Preferably, the grid-form rib is formed by intersection of first ribs extending in a substantially toe-heel direction, and second ribs extending in a substantially face-back direction.

Preferably, a plurality of rib-surrounding regions, each of which is surrounded by two first ribs and two second ribs, are formed. Preferably, the additional rib extends so that each of the rib-surrounding regions are divided into two parts.

Preferably, the additional rib is sloped to be closer to a back side as approaching to the heel side.

A slope angle of the additional rib relative to a face-back direction is defined as θa. Preferably, the angle θa is equal to or greater than 30° and equal to or less than 70°.

Advantageous Effects of the Invention

It is possible to obtain a golf club head excellent in hitting sound and flight distance performance.

BRIEF DESCRIPTION OF THE DRAWINGS

In FIG. 3, ribs provided on an inner surface of a crown are shown by solid lines.

DESCRIPTION OF EMBODIMENTS

Hereinafter, the present invention will be described in detail according to the preferred embodiments with appropriate references to the accompanying drawings.

Figure 1:
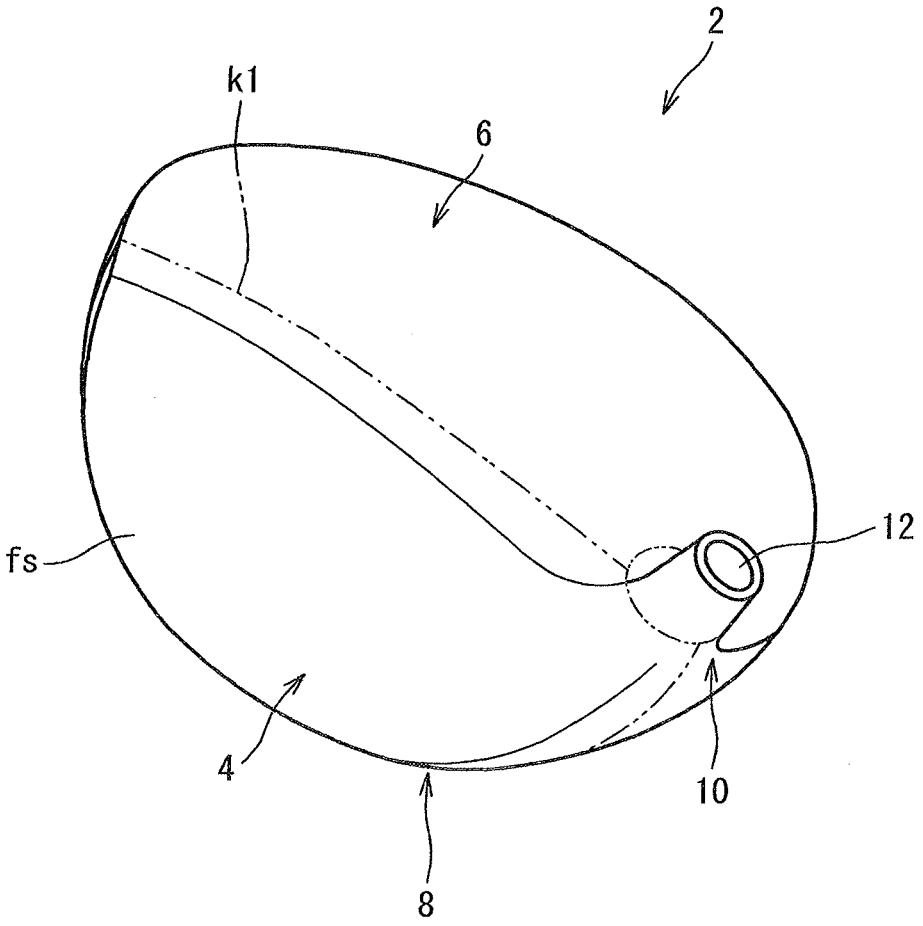
FIG. 1 is a perspective view of a golf club head according to an embodiment of the present invention.
Figure 2:
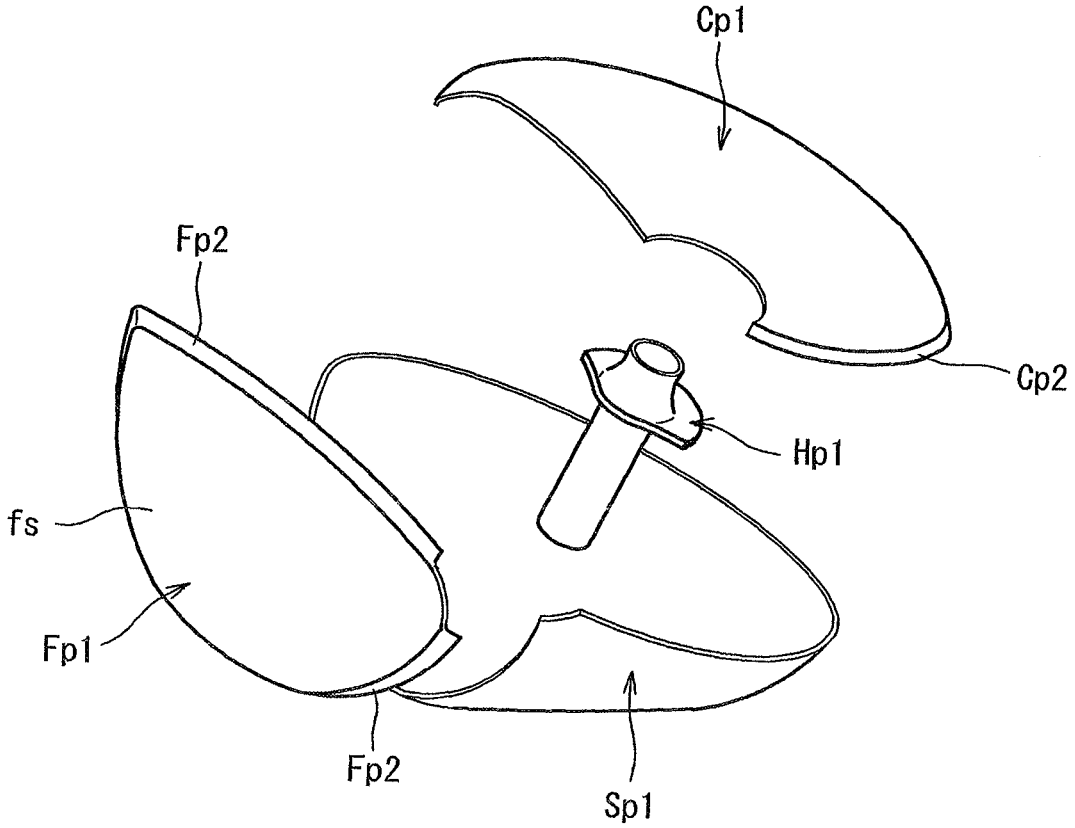
FIG. 2 is an exploded perspective view of the head of FIG. 1.
Figure 3:
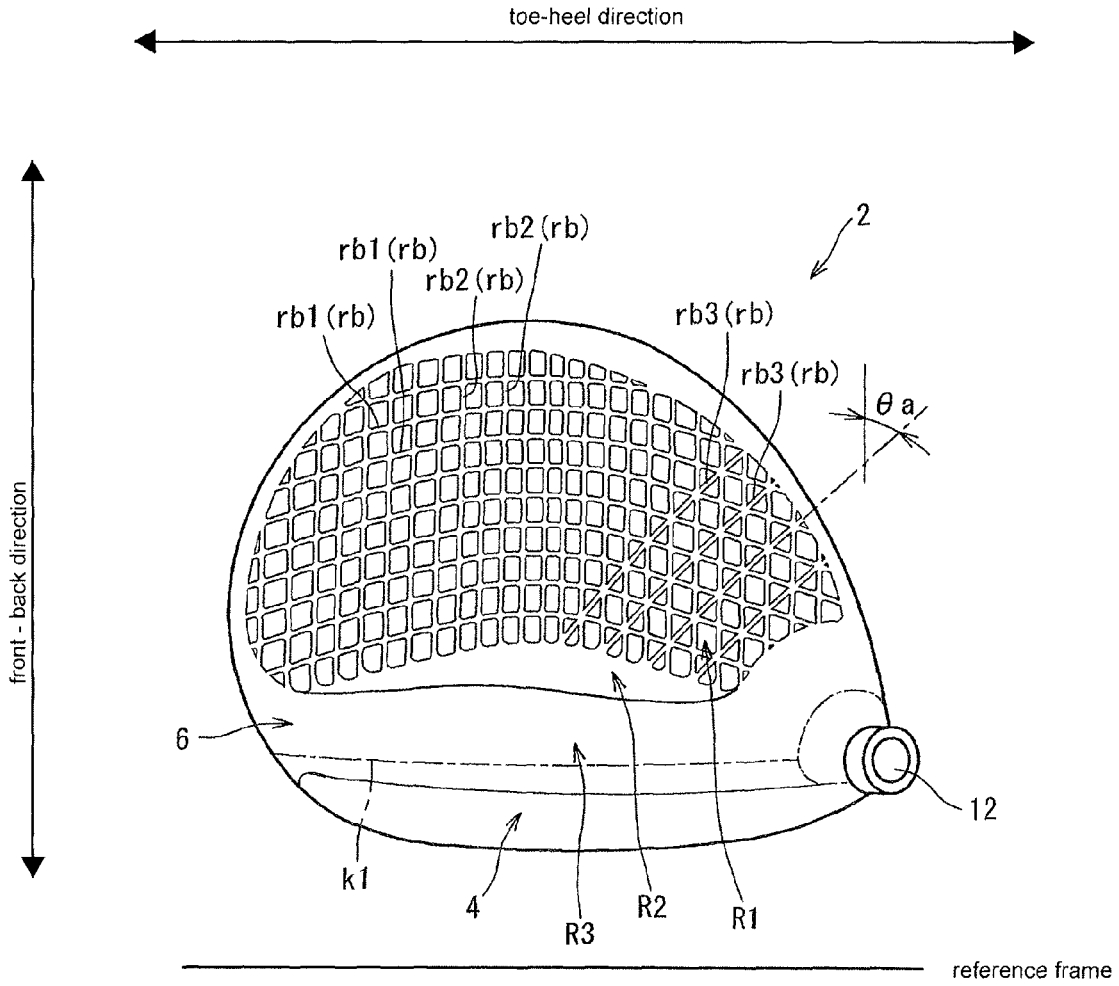
FIG. 3 is a plan view of the head of FIG. 1.

FIG. 1 is a perspective view of a golf club head 2 according to a first embodiment of the present invention. FIG. 2 is an exploded perspective view of the head 2. FIG. 3 is a plan view of the head 2. In FIG. 3, ribs (to be described later) provided on an inner surface of a crown is depicted by solid lines. Properly, the ribs should be shown by dashed lines, not solid lines. However, in view of making the drawing easy to see, solid lines are used.

The head 2 includes a face 4, a crown 6, a sole 8, and a hosel 10. The face 4 has a face surface fs. The face surface fs is a ball hitting face. The crown 6 extends toward the back of the head from the upper edge of the face 4. The sole 8 extends toward the back of the head from the lower edge of the face 4. The head 2 is hollow. The head 2 is a wood type golf club head.

The head 2 has a four-piece structure. Constituent members of the head 2 are a face member Fp1, a sole member Sp1, a crown member Cp1 and a hosel member Hp1. The head 2 is manufactured by welding these members.

The face member Fp1 constitutes the whole face 4. Furthermore, the face member Fp1 includes a backward extension part Fp2. The backward extension part Fp2 constitutes a part of the crown 6. The backward extension part Fp2 constitutes a part of the sole 8. Because of the existence of the backward extension part Fp2, a boundary between the face 4 and other parts is shifted from a welded position. The boundary between the face 4 and other parts (such as crown 6) forms a corner part. Stress is apt to be concentrated on the corner part. The position of the corner part differs from the welded position because of the existence of the backward extension part Fp2. The difference between the positions relieves the stress concentration to the welded position. Moreover, the welded position is shifted to backward by the backward extension part Fp2. Since the welded position is located far from the face 4, stress acting on the welded position is suppressed.

The face member Fp1 having the backward extension part Fp2 is also referred to as a cup face. A boundary k1 between the members is shown by a two-dot chain line in FIG. 1. The boundary k1 is not visually recognized in the completed head 2 after coating.

The crown member Cp1 constitutes most of the crown 6. Furthermore, a downward extension part Cp2 is provided on a peripheral part of the crown member Cp1. The crown member Cp1 and the sole member Sp1 are welded at an edge of the downward extension part Cp2. A boundary between the crown 6 and the sole 8 forms a corner part. Stress is apt to be concentrated on the corner part. The position of the corner part differs from the welded position because of the existence of the downward extension part Cp2. The difference between the positions relieves the stress concentration to the welded position.

The hosel 10 has a shaft hole 12 to which a shaft is mounted. The shaft, not shown in the drawings, is inserted into the shaft hole 12. The shaft hole 12 has a center axial line Z1, although not shown in the drawings. The center axial line Z1 conforms to a shaft axial line of a golf club having the head 2.

As shown in FIG. 3, a plurality of ribs rb are formed on the inner surface of the crown 6. As discussed above, in FIG. 3, the ribs rb that should be shown by dashed lines are shown by solid lines.

Figure 4:
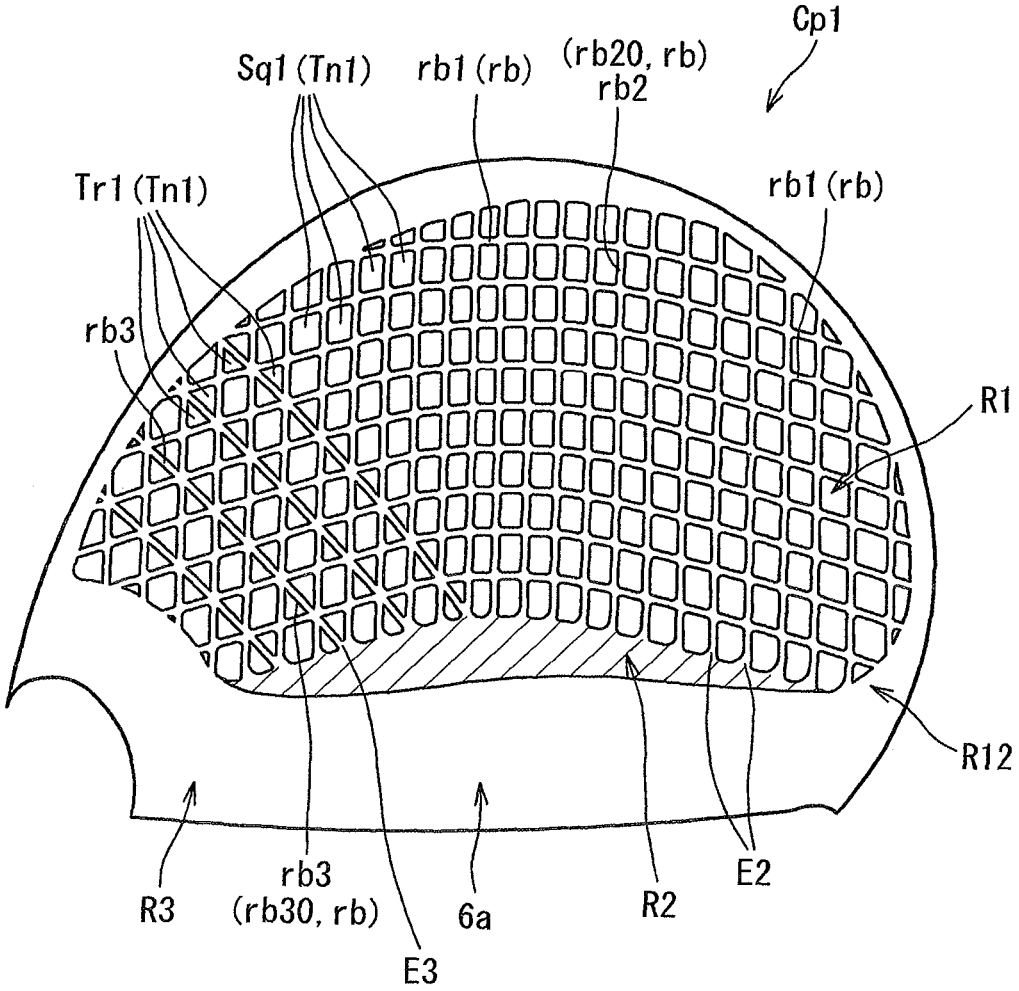
FIG. 4 is a plan view of the inner surface of the crown member.

FIG. 4 is a plan view of the crown member Cp1. FIG. 4 is a plan view of the inner surface (reverse surface) of the crown member Cp1. A large number of ribs rb are formed on the crown inner surface 6*a*.

The ribs rb are formed by chemical milling. In the process for forming the ribs, the crown member is masked before the ribs are formed thereon. Portions on which the ribs are formed are masked. The masking is, for example, a coating material having resistance against an etchant. Next, etching is performed. Portions which are not masked are chemically ground by the etching. Masked portions are not ground. Next, the masking is removed. As a result of these processes, masked portions are relatively projected. The projections are the ribs rb. The complex-shaped ribs rb can be formed with high accuracy by the chemical milling.

The method for forming the ribs rb is not restricted. The ribs rb may be formed by casting, forging, and NC process, or the like. In light of enhancing the accuracy of the height of ribs rb, chemical milling is preferable.

In the present application, a reference vertical plane, a face-back direction and a toe-heel direction are defined. A reference state denotes a state that the center axial line Z1 is contained in a plane P1 perpendicular to a horizontal plane H and the head 2 is placed on the horizontal plane H at a prescribed lie angle and real loft angle. The reference vertical plane denotes the plane P1. The prescribed lie angle and real loft angle are appeared, for example, in a product catalog.

In the present application, the toe-heel direction is a direction of an intersection line between the reference vertical plane and the horizontal plane H.

In the present application, the face-back direction is a direction perpendicular to the toe-heel direction and parallel to the horizontal plane H.

In the present application, a face center is defined. A maximum width Wx of the face surface in the toe-heel direction is determined. Furthermore, a middle position Px of the maximum width Wx in the toe-heel direction is determined. At the position Px, a middle point Py of the face surface in an up-down direction is determined. The point Py is defined as the face center.

Grid-form rib is provided on the crown inner surface 6*a*. The grid-form rib is formed by first ribs rb1 and second ribs rb2.

The first ribs rb1 extend in a substantially toe-heel direction. The substantially toe-heel direction denotes a direction having an angle of within ±20° relative to the toe-heel direction. This direction is determined in plan views shown in FIGS. 3 and 4.

A plurality of first ribs rb1 are provided. In the embodiment of FIG. 4, nine first ribs rb1 are provided. The plurality of first ribs rb1 are arranged with intervals in the face-back direction.

The second ribs rb2 extend in a substantially face-back direction. The substantially face-back direction denotes a direction having an angle of within ±20° relative to the face-back direction. This direction is determined in plan views shown in FIGS. 3 and 4. Preferably, the second ribs rb2 extend in a direction having an angle of within ±10° relative to the face-back direction. In the embodiment, the second ribs rb2 extend in a direction having an angle of within ±5° relative to the face-back direction. This direction is determined in plan views shown in FIGS. 3 and 4.

A plurality of second ribs rb2 are provided. In the embodiment of FIG. 4, 25 second ribs rb2 are provided. The plurality of second ribs rb2 are arranged with intervals in the toe-heel direction.

The grid-form rib is formed by the intersection of the first ribs rb1 and the second ribs rb2. In the grid-form rib, the first ribs rb1 and the second ribs rb2, which extend in respective substantial two directions, intersect with each other. Stress acting to the crown 6 in hitting is considered to be complex. The grid-form rib can effectively suppress various deformations as compared with ribs extending in only one direction. The grid-form rib effectively enhance the strength of the crown 6.

A region in which the grid-form rib is provided is defined as a rib region R1. As shown in FIGS. 3 and 4, the crown 6 includes a second region R2. Furthermore, the crown 6 includes a third region R3. The ribs rb are not provided on the second region R2. The ribs rb are not provided on the third region R3. The rib region R1 includes a thin region Tn1 (to be described later).

In FIG. 4, the second region R2 is shown by hatching. In FIG. 4, a region that includes no hatching and no ribs is the third region R3. In the crown member Cp1, a region excluding the second region R2 and the third region R3 is the rib region R1.

The second region R2 is positioned on the face side of the rib region R1. The rib region R1 and the second region R2 are connected to each other. The rib region R1 and the second region R2 form a total region R12. The third region R3 surrounds the total region R12.

An additional rib rb3 is provided on the heel side of the rib region R1. The additional rib rb3 is position on the heel side relative to the face center.

A rib-surrounding region Sq1 is formed by the grid-form rib (See FIG. 4). The rib-surrounding region Sq1 is a region surrounded by two first ribs rb1 and two second ribs rb2. The rib-surrounding region Sq1 has a substantially rectangular shape. The rib-surrounding region Sq1 has a shape like a rectangle, the four corners of which are rounded. A plurality of rib-surrounding regions Sq1 are formed. A large number of the rib-surrounding regions Sq1 are formed.

The additional rib rb3 is disposed so as to divide the rib-surrounding region Sq1. The additional rib rb3 divides one rib-surrounding region Sq1 into two parts. Divided regions Tr1 are formed by the division. In the embodiment, the divided region Tr1 has a substantially triangular shape. A plurality of divided regions Tr1 are formed. A large number of divided regions Tr1 are formed.

The rib-surrounding regions Sq1 and the divided regions Tr1 are the thin regions Tn1, each of which is surrounded by the ribs rb.

One additional rib rb3 divides a plurality of rib-surrounding regions Sq1.

The additional rib rb3 extends substantially along diagonal lines of the rib-surrounding regions Sq1. The divided region Tr1 is surrounded by one first rib rb1, one second rib rb2 and one additional rib rb3. The divided region Tr1 has a substantially triangular shape.

In the embodiment, each region has a thickness (crown thickness TC) as follows.

- Rib region R1 (portions in which ribs rb exist): equal to or greater than 0.55 mm and equal to or less than 0.65 mm
- Rib region R1 (thin regions Tn1): equal to or greater than 0.35 mm and less than 0.55 mm
- Second region R2: equal to or greater than 0.55 mm and equal to or less than 0.65 mm
- Third region R3: equal to or greater than 0.60 mm and equal to or less than 0.80 mm In the embodiment, the thickness of the crown 6 is equal to or greater than 0.35 mm and equal to or less than 0.80 mm. The thinner the crown 6 is, the greater the effect of the ribs rb is. In this respect, the thickness of the crown 6 is preferably equal to or less than 1 mm, and more preferably equal to or less than 0.8 mm.

In the embodiment, the average height of the ribs rb is 0.15 mm.

As shown in FIGS. 3 and 4, the additional rib rb3 extends aslope so as to be closer to the back side as approaching to the heel side.

The rib-surrounding regions Sq1 are portions subjected to the milling. In the chemical milling, the rib-surrounding regions Sq1 are not masked. The rib-surrounding regions Sq1 are subjected to the milling thereby to be made thin. As a result, portions of the ribs rb become thicker than the rib-surrounding regions Sq1. The thickness by which the rib-surrounding regions Sq1 are milled is equal to the height of the ribs rb.

The divided regions Tr1 are also portions subjected to the milling as well as the rib-surrounding regions Sq1. In the chemical milling, the divided regions Tr1 are not masked. The divided regions Tr1 are subjected to the milling thereby to be made thin. As a result, portions of the ribs rb become thicker than the divided regions Tr1. The thickness by which the divided regions Tr1 are milled is equal to the height of the ribs rb.

Thus, the thin regions Tn1 are formed by the milling.

Figure 5:
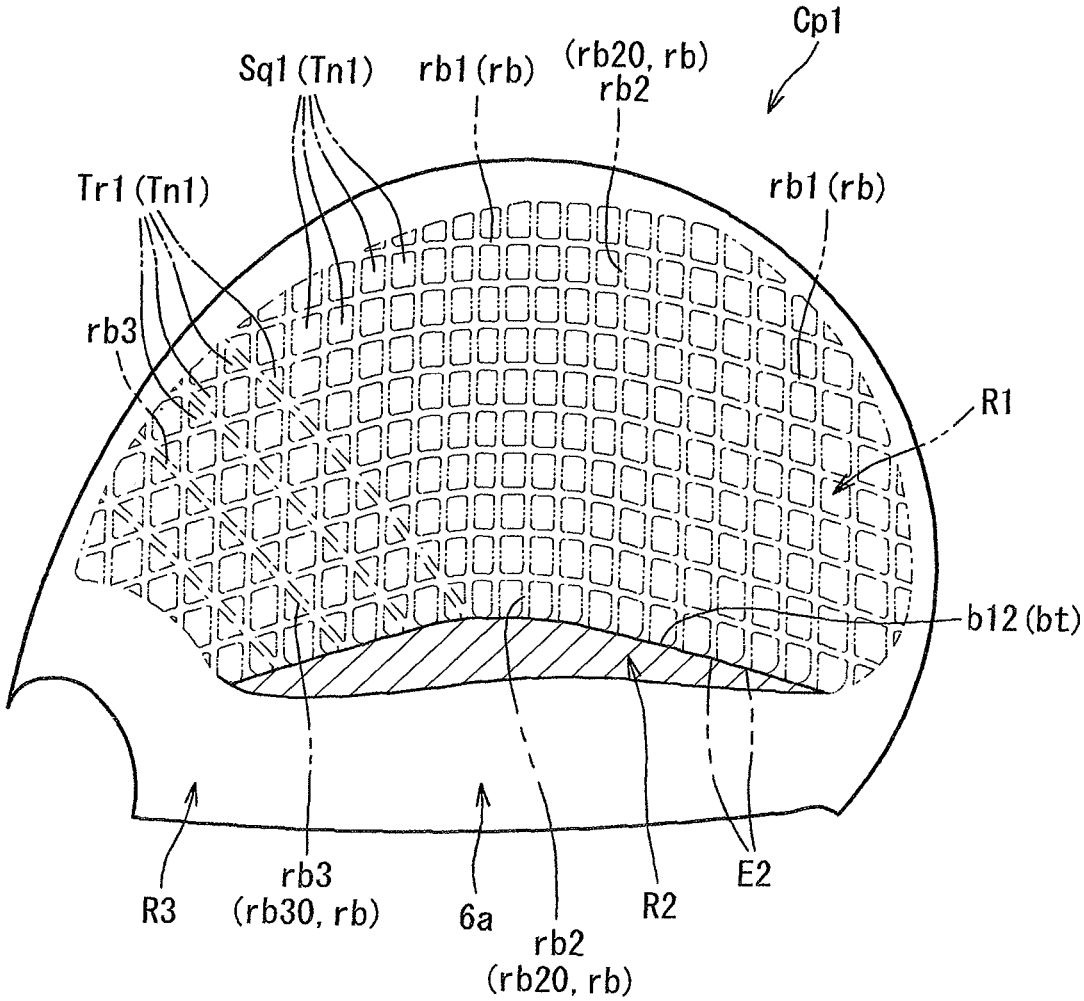
FIG. 5 is a plan view for showing a second region.

FIG. 5 is a plan view of the crown inner surface 6*a* as well as FIG. 4. In FIG. 5, portions other than the second region R2 is shown by a virtual line (two-dot chain line) in order to highlight the second region R2.

The second region R2 is a portion which is not milled. The second region R2 is flush with the ribs rb. The crown thickness TC of portions in which ribs rb are provided is equal to that of the second region R2. In the present application, the crown thickness TC includes the height of the rib rb.

The second region R2 is positioned on the face side of the rib region R1. As shown in FIG. 5, a boundary line b12 between the rib region R1 and the second region R2 includes a protruding extension part bt extending curvedly so as to protrude toward the back side. In the embodiment, the whole boundary line b12 is the protruding extension part bt.

The second ribs rb2 include a rib rb20, one end E2 of which is connected to the second region R2. The second region R2 is present on the face side of the second ribs rb2. The end E2 on the face side of the second rib rb2 is connected to the second region R2. The end E2 constitutes a part of the boundary line b12. The end E2 constitutes a part of the boundary line bt. A plurality of ends E2 are arranged along the boundary line b12. The plurality of ends E2 are arranged along the protruding extension part bt.

The additional ribs rb3 include a rib rb30, one end E3 of which is connected to the second region R2. In the embodiment, all additional ribs rb3 are the ribs rb30. The end E3 constitutes a part of the boundary line b12. The end E3 constitutes a part of the boundary line bt. A plurality of ends E3 are arranged along the boundary line b12. The plurality of ends E3 are arranged along the protruding extension part bt.

The additional rib rb3 is positioned on the heel side relative to the face center. As concerns all the ribs rb3, the entire additional rib rb3 are positioned on the heel side relative to the face center. In each of all the additional ribs rb3, a center of gravity of the additional rib rb3 is positioned on the heel side relative to the face center. The additional rib rb3 has an effect of making the center of gravity of the head close to the heel (a heel center-of-gravity effect). The face is likely to be turned by the heel center-of-gravity effect. Therefore, the opening of the face at impact is suppressed to improve a flight distance performance.

The average thickness of the second region R2 is greater than the average thickness of the thin regions Tn1. By the second region R2 having a great thickness, the strength of the crown on the face side is enhanced. In hitting, a great stress acts to the vicinity of the face. The second region R2 is located on the face side of the rib region R1 to effectively enhance the strength of the crown.

An average value of the crown thickness TC in the second region R2 is defined as A2, and an average value of the crown thickness TC in the thin regions Tn1 is defined as A1. In light of obtaining the crown 6 that is lightweight and has great rigidity and high strength, A2/A1 is preferably equal to or greater than 1.1, and more preferably equal to or greater than 1.2. However, when A2/A1 is excessive, the thickness A2 becomes excessive, and a weight of the crown might be increased, if anything. In addition, when A2/A1 is excessive, the thickness A1 becomes too small, and the strength of the crown might be deteriorated, if anything. In these respect, A2/A1 is preferably equal to or less than 1.5, and more preferably equal to or less than 1.4.

An average thickness of the crown thickness Tc in portions in which the ribs rb are provided is defined as Ar. In the embodiment, the average thickness Ar is equal to the average thickness A2. In light of enhancing the effect by the second region R2 as described above, the average thickness A2 is equal to or greater than the average thickness Ar. A difference (Ar−A1) is equal to the average height of the ribs rb.

As describe above, the boundary line b12 includes the protruding extension part bt. That is, the back side of the second region R2 has a shape that protrudes toward the back side. This shape can make the rib region R1 large while effectively reinforcing the vicinity of the face center. Therefore, the vicinity of the face center in which stress in hitting is particularly great can be effectively reinforced. In addition, the effect by the ribs rb is enhanced by making the rib region R1 large.

The first ribs rb1 extend substantially along the protruding extension part bt. The first ribs rb1 extend curvedly so as to protrude toward the back side. If there is not the curve, when disposal of the first rib rb1 at a face-back directional position on which the second region R2 exists is attempted, the first rib rb1 is split by the second region R2. By the curve of the first rib rb1, this split is avoided. Furthermore, the curve is also applied to the first rib rb1 positioned on the back side, and thereby the plurality of first ribs rb1 can be substantially regularly arranged with predetermined intervals. Therefore, the ribs rb and the thin regions Tn1 can be arranged in a well-balanced manner.

The additional rib rb3 reinforces particularly the heel side of the crown 6. By the heel reinforcing effect, deformation on the heel side of the crown 6 can be suppressed. By the heel-deformation suppression effect, directivity in hitting at the heel side of the face 4 can be improved.

The heel reinforcing effect can reach to the toe side by the first ribs rb1 extending from the heel side to the toe side. As described above, since the split of the first ribs rb1 is avoided, the heel reinforcing effect can reach to the toe side. Therefore, when a ball is hit at the toe side of the face 4, deformation on the toe side of the crown 6 can be suppressed. Therefore, deformation on the toe side of the face 4 can also be suppressed. By the toe-deformation suppression effect, directivity in hitting at the toe side of the face 4 can be improved.

As described above, the additional ribs rb3 extend aslope so as to be closer to the back side as approaching to the heel side. This slope make easy to connect the ends E3 of the additional ribs rb3 to the second region R2 while disposing the additional ribs rb3 on the heel side. By the connection of the additional ribs rb3 and the second region R2, the reinforcing effect by the second region R2 having a great crown thickness TC can be effectively transmitted to the rib region R1. Therefore, the heel reinforcing effect by the additional ribs rb3 is further enhanced. In addition, by the slope, the additional ribs rb3 are positioned wholly on the heel side while securing the connection to the second region R2. Therefore, the heel center-of-gravity effect and the heel reinforcing effect are enhanced.

As described above, the additional ribs rb3 split the rib-surrounding regions Sq1. Additional ribs rb3 splitting the rib-surrounding regions Sq1 and the grid-form rib (the first ribs rb1 and the second ribs rb2) are combined. By this combination, the grid-form rib is effectively reinforced by the additional ribs rb3. In the present application, this reinforcing effect is also referred to as a bracing effect. The heel reinforcing effect is enhanced by the bracing effect. The bracing effect can be further enhanced by disposing the additional ribs so as to be diagonal lines.

An angle between an extending direction of the additional rib rb3 and the face-back direction is shown by a double-pointed arrow θa in FIG. 3. In light of the heel reinforcing effect, the heel center-of-gravity effect, and the bracing effect, the lower limit of the angle θa is preferably equal to or greater than 30°, and more preferably equal to or greater than 40°. The upper limit of the angle θa is preferably equal to or less than 70°, and more preferably equal to or less than 60°. The extending direction of the additional rib rb3 is determined by a center line in a width direction of the additional rib rb3. The extending direction is determined in a plane view like FIG. 3. When the additional rib rb3 extends curvedly, the extending direction is determined by tangent lines of the center line in the width direction. The angle θa can be decided on each point present on the center line in the width direction.

It has been found that a hitting sound is improved by providing the additional rib rb3. It is considered that the heel reinforcing effect is the cause of the improvement of hitting sound. Although details for what causes the improvement effect of hitting sound is unknown, it is assumed that the heel side of the crown is apt to vibrate relatively largely, and thereby the vibration on the heel side should affect a hitting sound.

In light of enhancing the effect of the ribs rb, the average height of the ribs rb is preferably equal to or greater than 0.05 mm, more preferably equal to or greater than 0.10 mm, and still more preferably equal to or greater than 0.15 mm. In light of suppressing the weight of the crown, the average height of the ribs rb is preferably equal to or less than 1 mm, more preferably equal to or less than 0.7 mm, and more preferably equal to or less than 0.4 mm.

Thus, the preferable average height of the ribs rb is equal to or less than 1 mm. In light of accurately forming the ribs rb each having such a low height, the method for forming the ribs rb is preferably chemical milling.

An area of the rib region R1 is defined as Mr, and the entire area of the inner surface of the crown 6 is defined as Mc. In light of enhancing the effect of the ribs rb, Mr/Mc is preferably equal to or greater than 0.4, more preferably equal to or greater than 0.5, and still more preferably equal to or greater than 0.6. In light of providing a thick part on the face side of the rib region R1, Mr/Mc is equal to or less than 0.9, more preferably equal to or less than 0.85, and still more preferably equal to or less than 0.8. The thick part means a portion thicker than the thin region Tn1. In the embodiment, the thick part means the second region R2 and/or the third region R3.

A head volume is not restricted. As the head volume is greater, the hitting sound tends to be increased. In addition, as the head volume is greater, the crown 6 tends to be thinner. Therefore, the effect of the ribs rb is particularly high, when the head volume is great. In this respect, the head volume is preferably equal to or greater than 400 cc, more preferably equal to or greater than 420 cc, and still more preferably equal to or greater than 440 cc. In light of compliance with regulations regarding golf clubs, the head volume is preferably equal to or less than 470 cc, and more preferably equal to or less than 460 cc.

The material for the head is not restricted. As the material of the head, metal and CFRP (Carbon Fiber Reinforced Plastic) or the like are exemplified. As the metal, one or more kinds of metals selected from pure titanium, a titanium alloy, stainless steel, maraging steel, an aluminum alloy, a magnesium alloy and a tungsten-nickel alloy are exemplified. SUS630 and SUS304 are exemplified as stainless steel. As the specific example of stainless steel, CUSTOM450 (manufactured by Carpenter Company) is exemplified. As the titanium alloy, 6-4 titanium (Ti-6 A1-4V) and Ti-15V-3 Cr-3 Sn-3 A1 or the like are exemplified. When the volume of the head is great, the hitting sound is likely to be increased. The present invention is particularly effective in a head having a great hitting sound. In this respect, the material of the head is preferably the titanium alloy. The present invention is effective when the crown is thin. In this respect, the material of the crown is preferably the titanium alloy.

When the chemical milling is used for forming the ribs rb, the material of the crown is preferably metal.

A method for manufacturing the head is not restricted. Usually, a hollow head is manufactured by joining two or more members. A method for manufacturing the members constituting the head is not restricted. As the method, casting, forging and press forming are exemplified.

Examples of the structures of the heads include a two-piece structure in which two members integrally formed separately are joined, a three-piece structure in which three members integrally formed separately are joined, and a four-piece structure in which four members integrally formed separately are joined.

EXAMPLES

Hereinafter, the effects of the present invention will be clarified by examples. However, the present invention should not be interpreted in a limited way based on the description of examples.

Example

A face member, a sole member, a crown member and a hosel member as shown in FIG. 2 were obtained by forging. Titanium alloy was used as the material for all the members. The material of the crown member was the trade name "Super-TIX 51AF" manufactured by NIPPON STEEL & SUMITOMO METAL CORPORATION.

The crown member was subjected to chemical milling by a known method. In the chemical milling, masking was performed after treatments such as degreasing. The masking was performed to portions other than thin regions. The masked crown member was subjected to etching. The etching was performed by a known method. In the etching, a depth of the milling was controlled. By the etching, the thin regions were formed. A crown member having ribs rb as shown in FIG. 4 was obtained through steps such as removing the masking.

Other members were joined to the crown member to obtain a head of Example. A 46-inch golf club was produced by using the head.

Comparative Example 1

A head and a golf club of Comparative Example 1 were obtained in the same manner as in Example except that the additional ribs rb3 were not provided.

Comparative Example 2

Figure 6:
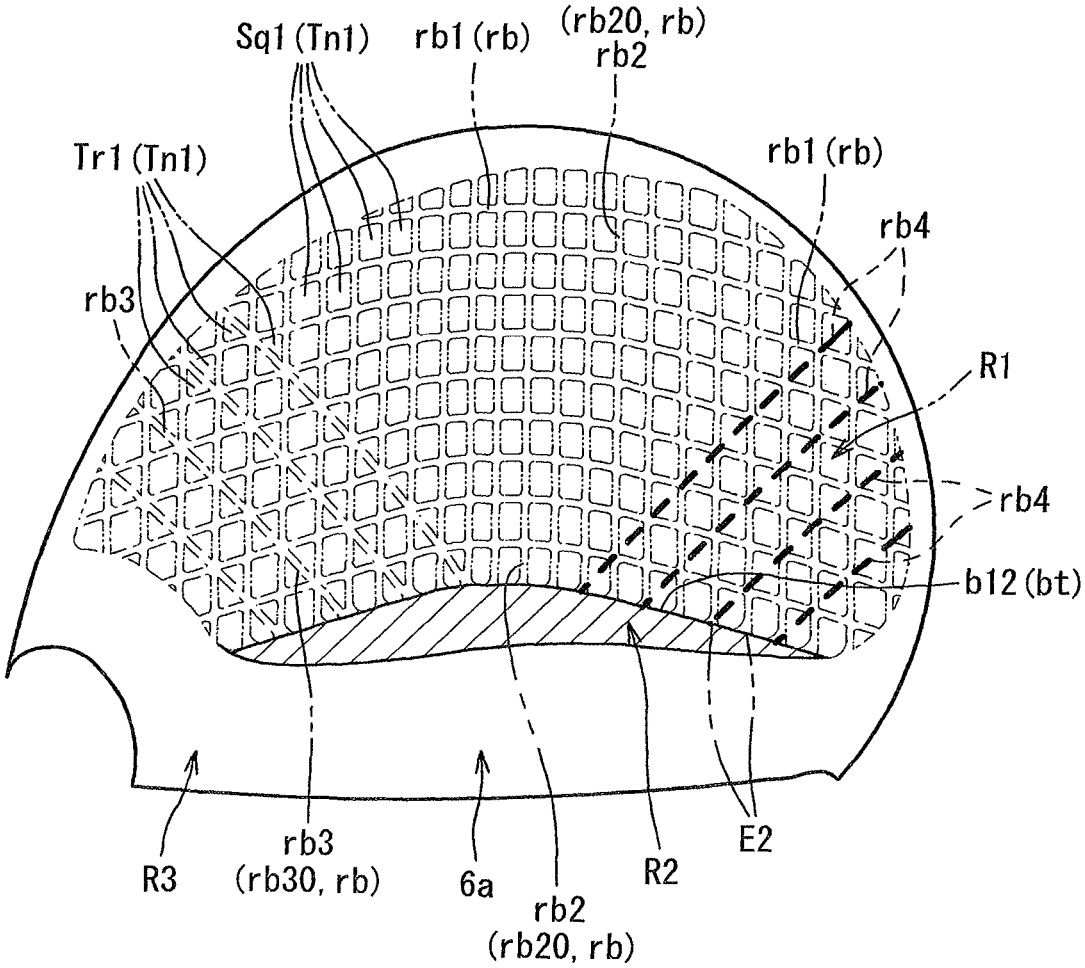
FIG. 6 is a plan view for showing positions of ribs rb4 in Comparative Example 2.

Four ribs rb4 were provided on the toe side instead of the additional ribs rb3. The height and the width of these ribs rb4 were the same as those of the additional ribs rb3. Dashed bold lines in FIG. 6 show the positions of the ribs rb4. Ahead and a golf club of Comparative Example 2 were obtained in the same manner as in Example except that the ribs rb4 were provided instead of the additional ribs rb3.

[Evaluation of Hitting Sound]

A swing robot was equipped with each of the golf clubs, and hit balls at a head speed of 45 m/s. The hitting point was the face center. The trade name "SRIXON Z-STAR" manufactured by DUNLOP SPORTS CO. LTD. was used as the balls. Ten golf players evaluated hitting sounds of those hittings. The hitting sounds were evaluated on a scale of one to five. The higher and the better the hitting sound is, the higher the score is. The average scores of the ten golf players are as follows. Example was evaluated higher than Comparative Examples 1 and 2.

Example: 4.3 Points

Comparative Example 1: 3.2 Points

Comparative Example 2: 3.7 Points

[Evaluation of Flight Distance Performance]

Ten testers having a head speed in a driver shot of 40 to 45 m/s hit balls with each of the clubs. Each tester hit balls ten times with each club. The trade name "SRIXON Z-STAR" manufactured by DUNLOP SPORTS CO. LTD. was used as the balls. As the flight distance, a total flight distance including run in addition to carry was adopted. The average value of the obtained flight distance data are as follows. Example is more excellent in flight distance performance than Comparative Examples 1 and 2.

Example: 237 Yards

Comparative Example 1: 233 Yards

Comparative Example 2: 234 Yards

INDUSTRIAL APPLICABILITY

The present invention is applicable to all types of golf club heads such as wood type heads, utility type heads, and hybrid type heads or the like.

DESCRIPTION OF THE REFERENCE CHARACTERS

2 . . . head
4 . . . face
6 . . . crown
6*a* . . . crown inner surface
8 . . . sole
10 . . . hosel
12 . . . shaft hole
rb . . . rib
rb1 . . . first rib
rb2 . . . second rib
rb3 . . . additional rib
Sq1 . . . rib-surrounding region
Tr1 . . . divided region
Tn1 . . . thin region
R1 . . . rib region
R2 . . . second region (thick part)
R3 . . . third region (thick part)

The invention claimed is:

1. A golf club head comprising:
a face;
a sole; and
a crown, wherein
grid-form rib is provided on an inner surface of the crown,
when a first region on which the grid-form rib is provided is defined as a rib region, a plurality of additional ribs are further provided on the rib region,
in each of the additional ribs, a center of gravity of the additional rib is positioned on a heel side relative to a face center,
the grid-form rib is formed by intersection of first ribs extending in a direction having an angle of with ±20° relative to a toe-heel direction in a plan view and second ribs extending in a direction having an angle ±20° relative to a face-back direction in the plan view, the additional ribs are not the first ribs and not the second ribs, and each of the additional ribs extends at an angle relative to an adjacent first rib and adjacent second rib.

2. The golf club head according to claim 1, wherein a plurality of rib-surrounding regions, each of which is surrounded by two first ribs and two second ribs, are formed, and at least one of the additional ribs extends so as to divide each of the plurality of rib-surrounding regions through which it passes into two parts.

3. The golf club head according to claim 2, wherein an second region is further provided on the inner surface of the crown, the second region is positioned on the face side of the rib region, and an average thickness of the second region is greater than an average thickness of the rib-surrounding regions.

4. The golf club head according to claim 3, wherein one end of at least one of the additional ribs is connected to the second region.

5. The golf club head according to claim 3, wherein the grid-form rib and the additional ribs are not provided on the second region.

6. The golf club head according to claim 1, wherein at least one of the additional ribs is sloped to be closer to a back side as approaching to the heel side.

7. The golf club head according to claim 6, wherein when a slope angle of the additional rib relative to a face-back direction is defined as θa, the angle θa is equal to or greater than 30° and equal to or less than 70°.

8. The golf club head according to claim 1, wherein the entire additional ribs are positioned on the heel side relative to the face center as concerns all the additional ribs.

9. The golf club head according to claim 1, wherein an second region is further provided on the inner surface of the crown, the second region is positioned on the face side of the rib region, and the grid-form rib and the additional ribs are not provided on the second region.

10. The golf club head according to claim 9, wherein one end of at least one of the additional ribs is connected to the second region.

11. The golf club head according to claim 9, wherein a third region is further provided on the inner surface of the crown, the third region surrounds the rib region and the second region, and the grid-form rib and the additional ribs are not provided on the third region.

* * * * *